US010711569B2

(12) United States Patent
Rong et al.

(10) Patent No.: US 10,711,569 B2
(45) Date of Patent: Jul. 14, 2020

(54) DOWNHOLE FLUID FLOW CONTROL SYSTEM HAVING A TEMPORARY CONFIGURATION

(71) Applicant: Floway, Inc., Plano, TX (US)

(72) Inventors: Xinqi Rong, Plano, TX (US); Liang Zhao, Plano, TX (US)

(73) Assignee: Floway, Inc., Plano, TX (US)

( * ) Notice: Subject to any disclaimer, the term of this patent is extended or adjusted under 35 U.S.C. 154(b) by 0 days.

(21) Appl. No.: 16/520,596

(22) Filed: Jul. 24, 2019

(65) Prior Publication Data

US 2019/0345793 A1 Nov. 14, 2019

Related U.S. Application Data

(63) Continuation-in-part of application No. 16/206,512, filed on Nov. 30, 2018, now Pat. No. 10,364,646, which is a continuation of application No. 16/048,328, filed on Jul. 29, 2018, now Pat. No. 10,174,588, which is a continuation of application No. 15/855,747, filed on Dec. 27, 2017, now Pat. No. 10,060,221.

(51) Int. Cl.

| | |
|---|---|
| ***E21B 34/08*** | (2006.01) |
| ***E21B 49/08*** | (2006.01) |
| ***E21B 43/08*** | (2006.01) |

(52) U.S. Cl.

CPC ..... *E21B 34/08* (2013.01); *E21B 43/08* (2013.01); *E21B 49/08* (2013.01); *E21B 49/0875* (2020.05)

(58) Field of Classification Search

CPC ..... E21B 49/08; E21B 2049/08; E21B 47/06; E21B 43/12; E21B 34/08; E21B 43/08; E21B 49/0875; E21B 49/087; G05D 7/01; G05D 7/0113; G05D 7/0146; G05D 7/0153; G05D 7/00; F16K 31/122; Y10T 137/0379; Y10T 137/2562

See application file for complete search history.

(56) References Cited

U.S. PATENT DOCUMENTS

| | | | |
|---|---|---|---|
| 2,579,334 | A | 12/1951 | Norris |
| 5,234,025 | A | 8/1993 | Skoglund et al. |
| 6,786,285 | B2 | 9/2004 | Johnson et al. |
| 7,823,645 | B2 | 11/2010 | Henriksen et al. |
| 7,870,906 | B2 | 1/2011 | Ali |
| 8,235,128 | B2 | 8/2012 | Dykstra et al. |

(Continued)

*Primary Examiner* — Wei Wang

(74) *Attorney, Agent, or Firm* — Lawrence Youst PLLC

(57) ABSTRACT

A downhole fluid flow control system includes a fluid control module having an upstream side, a downstream side and a main fluid pathway in parallel with a secondary fluid pathway each extending between the upstream and downstream sides. A valve element disposed within the main fluid pathway has open and closed positions. A viscosity discriminator including a viscosity sensitive channel forms at least a portion of the secondary fluid pathway. A differential pressure switch operable to open and close the valve element includes a first pressure signal from the upstream side, a second pressure signal from the downstream side and a third pressure signal from the secondary fluid pathway. The fluid control module includes a dissolvable member operable to temporarily lockout the valve element in the open position or temporarily prevent fluid flow through the main and secondary fluid pathways. The dissolvable member is dissolvable by a dissolution solvent downhole.

21 Claims, 10 Drawing Sheets

(56) References Cited

U.S. PATENT DOCUMENTS

| | | | |
|---|---|---|---|
| 8,291,976 | B2 | 10/2012 | Schultz et al. |
| 8,356,668 | B2 | 1/2013 | Dykstra et al. |
| 8,584,762 | B2 | 11/2013 | Fripp et al. |
| 8,752,629 | B2 | 6/2014 | Moen |
| 8,820,413 | B2 | 9/2014 | Mathiesen et al. |
| 8,875,797 | B2 | 11/2014 | Aakre et al. |
| 9,187,991 | B2 | 11/2015 | Fripp et al. |
| 9,556,706 | B1 | 1/2017 | Zhao |
| 9,683,429 | B2 | 6/2017 | Mathiesen et al. |
| 9,759,042 | B2 | 9/2017 | Zhao |
| 9,759,043 | B2 | 9/2017 | Zhao |
| 10,060,221 | B1 | 8/2018 | Rong et al. |
| 10,174,588 | B1 | 1/2019 | Rong et al. |
| 2011/0067878 | A1 | 3/2011 | Aadnoy |
| 2011/0198097 | A1 | 8/2011 | Moen |
| 2013/0112423 | A1 | 5/2013 | Dykstra et al. |
| 2013/0186634 | A1 | 7/2013 | Fripp et al. |
| 2014/0110128 | A1 | 4/2014 | Dykstra et al. |
| 2014/0216733 | A1 | 8/2014 | Mathiesen et al. |
| 2015/0040990 | A1 | 2/2015 | Mathiesen et al. |
| 2015/0060084 | A1 | 3/2015 | Moen et al. |
| 2016/0061004 | A1 | 3/2016 | Tunkiel et al. |
| 2017/0234106 | A1 | 8/2017 | Mathiesen et al. |

DOWNHOLE FLUID FLOW CONTROL SYSTEM HAVING A TEMPORARY CONFIGURATION

CROSS-REFERENCE TO RELATED APPLICATIONS

The present application is a continuation-in-part of application Ser. No. 16/206,512 filed Nov. 30, 2018, now U.S. Pat. No. 10,364,646, which is a continuation of application Ser. No. 16/048,328 filed Jul. 29, 2018, now U.S. Pat. No. 10,174,588, which is a continuation of application Ser. No. 15/855,747 filed Dec. 27, 2017, now U.S. Pat. No. 10,060,221.

TECHNICAL FIELD OF THE DISCLOSURE

The present disclosure relates, in general, to equipment used in conjunction with operations performed in hydrocarbon bearing subterranean wells and, in particular, to downhole fluid flow control systems that utilize dissolvable members to create temporary configurations for fluid control modules.

BACKGROUND

During the completion of a well that traverses a hydrocarbon bearing subterranean formation, production tubing and various completion equipment are installed in the well to enable safe and efficient production of the formation fluids. For example, to control the flowrate of production fluids into the production tubing, it is common practice to install a fluid flow control system within the tubing string including one or more inflow control devices such as flow tubes, nozzles, labyrinths or other tortuous path devices. Typically, the production flowrate through these inflow control devices is fixed prior to installation based upon the design thereof.

It has been found, however, that due to changes in formation pressure and changes in formation fluid composition over the life of the well, it may be desirable to adjust the flow control characteristics of the inflow control devices and, in particular, it may be desirable to adjust the flow control characteristics without the requirement for well intervention. In addition, for certain completions, such as long horizontal completions having numerous production intervals, it may be desirable to independently control the inflow of production fluids into each of the production intervals.

Attempts have been made to achieve these results through the use of autonomous inflow control devices. For example, certain autonomous inflow control devices include one or more valve elements that are fully open responsive to the flow of a desired fluid, such as oil, but restrict production responsive to the flow of an undesired fluid, such as water or gas. It has been found, however, that systems incorporating current autonomous inflow control devices suffer from one or more of the following limitations: fatigue failure of biasing devices; failure of intricate components or complex structures; lack of sensitivity to minor fluid property differences, such as light oil viscosity versus water viscosity; and/or the inability to highly restrict or shut off unwanted fluid flow due to requiring substantial flow or requiring flow through a main flow path in order to operate.

Accordingly, a need has arisen for a downhole fluid flow control system that is operable to independently control the inflow of production fluids from multiple production intervals without the requirement for well intervention as the composition of the fluids produced into specific intervals changes over time. A need has also arisen for such a downhole fluid flow control system that does not require the use of biasing devices, intricate components or complex structures. In addition, a need has arisen for such a downhole fluid flow control system that has the sensitivity to operate responsive to minor fluid property differences. Further, a need has arisen for such a downhole fluid flow control system that is operable to highly restrict or shut off the production of unwanted fluid flow though the main flow path.

SUMMARY

In a first aspect, the present disclosure is directed to a downhole fluid flow control system that includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A dissolvable prop member is configured to maintain the valve element in the open position. The dissolvable prop member is operable to be dissolved by a dissolution solvent downhole to allow the valve element to operate between the open and closed positions. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In some embodiments, the valve element may have first, second and third areas such that the first pressure signal acts on the first area, the second pressure signal acts on the second area and the third pressure signal acts on the third area. In such embodiments, the differential pressure switch may be operated responsive to a difference between the first pressure signal times the first area plus the second pressure signal times the second area ($P_1A_1+P_2A_2$) and the third pressure signal times the third area ($P_3A_3$). In certain embodiments, the magnitude of the third pressure signal increases with decreasing viscosity of the fluid flowing through the secondary fluid pathway. In some embodiments, the dissolution solvent may be an acidic fluid, a caustic fluid, water or a hydrocarbon fluid.

In a second aspect, the present disclosure is directed to a flow control screen including a base pipe with an internal passageway, a filter medium positioned around the base pipe and a fluid flow control system positioned in a fluid flow path between the filter medium and the internal passageway. The fluid flow control system includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A dissolvable prop member is configured to maintain the valve element in the open position. The dissolvable prop member is operable to be dissolved by a dissolution solvent downhole to allow the valve element to operate between the open and closed positions. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In a third aspect, the present disclosure is directed to a downhole fluid flow control method including positioning a fluid flow control system at a target location downhole, the fluid flow control system including a fluid control module having an upstream side, a downstream side and a main fluid pathway in parallel with a secondary fluid pathway each extending between the upstream and downstream sides, a viscosity discriminator and a differential pressure switch, the viscosity discriminator having a viscosity sensitive channel that forms at least a portion of the secondary fluid pathway; maintaining a valve element in an open position with a dissolvable prop member; exposing the dissolvable prop member to a dissolution solvent downhole to allow the valve element to operate between the open position and a closed position; producing a desired fluid from the upstream side to the downstream side through the fluid control module; operating the differential pressure switch to shift the valve element to the open position responsive to producing the desired fluid by applying a first pressure signal from the upstream side to a first area of the valve element, a second pressure signal from the downstream side to a second area of the valve element and a third pressure signal from the secondary fluid pathway to a third area of the valve element; producing an undesired fluid from the upstream side to the downstream side through the fluid control module; and operating the differential pressure switch to shift the valve element to the closed position responsive to producing the undesired fluid by applying the first pressure signal to the first area of the valve element, the second pressure signal to the second area of the valve element and the third pressure signal to the third area of the valve element; wherein, a magnitude of the third pressure signal is dependent upon the viscosity of a fluid flowing through the secondary fluid pathway such that the viscosity of the fluid operates the differential pressure switch, thereby controlling fluid flow through the main fluid pathway.

In a fourth aspect, the present disclosure is directed to a downhole fluid flow control system that includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A plurality of dissolvable plugs are configured to block fluid flow through the main and secondary fluid pathways. The dissolvable plugs are operable to be dissolved by a dissolution solvent downhole to allow fluid flow through the main and secondary fluid pathways. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In a fifth aspect, the present disclosure is directed to a flow control screen including a base pipe with an internal passageway, a filter medium positioned around the base pipe and a fluid flow control system positioned in a fluid flow path between the filter medium and the internal passageway. The fluid flow control system includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A plurality of dissolvable plugs are configured to block fluid flow through the main and secondary fluid pathways. The dissolvable plugs are operable to be dissolved by a dissolution solvent downhole to allow fluid flow through the main and secondary fluid pathways. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In a sixth aspect, the present disclosure is directed to a downhole fluid flow control method including positioning a fluid flow control system at a target location downhole, the fluid flow control system including a fluid control module having an upstream side, a downstream side and a main fluid pathway in parallel with a secondary fluid pathway each extending between the upstream and downstream sides, a viscosity discriminator and a differential pressure switch, the viscosity discriminator having a viscosity sensitive channel that forms at least a portion of the secondary fluid pathway; preventing fluid flow through the main and secondary fluid pathways with a plurality of dissolvable plugs; exposing the dissolvable plugs to a dissolution solvent downhole to allow fluid flow through the main and secondary fluid pathways; producing a desired fluid from the upstream side to the downstream side through the fluid control module; operating the differential pressure switch to shift the valve element to the open position responsive to producing the desired fluid by applying a first pressure signal from the upstream side to a first area of the valve element, a second pressure signal from the downstream side to a second area of the valve element and a third pressure signal from the secondary fluid pathway to a third area of the valve element; producing an undesired fluid from the upstream side to the downstream side through the fluid control module; and operating the differential pressure switch to shift the valve element to the closed position responsive to producing the undesired fluid by applying the first pressure signal to the first area of the valve element, the second pressure signal to the second area of the valve element and the third pressure signal to the third area of the valve element; wherein, a magnitude of the third pressure signal is dependent upon the viscosity of a fluid flowing through the secondary fluid pathway such that the viscosity of the fluid operates the differential pressure switch, thereby controlling fluid flow through the main fluid pathway.

In a seventh aspect, the present disclosure is directed to a downhole fluid flow control system that includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A dissolvable layer is disposed on an interior surface of the fluid control module and is configured to block fluid flow through the main and secondary fluid pathways. The dissolvable layer is operable to be dissolved by a dissolution solvent downhole to allow fluid flow through the main and secondary fluid pathways. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In a eighth aspect, the present disclosure is directed to a flow control screen including a base pipe with an internal passageway, a filter medium positioned around the base pipe and a fluid flow control system positioned in a fluid flow path between the filter medium and the internal passageway. The fluid flow control system includes a fluid control module having an upstream side, a downstream side and a main fluid pathway in parallel with a secondary fluid pathway each extending between the upstream and downstream sides. A valve element is disposed within the fluid control module. The valve element is operable between an open position wherein fluid flow through the main fluid pathway is allowed and a closed position wherein fluid flow through the main fluid pathway is prevented. A dissolvable layer is disposed on an interior surface of the fluid control module and is configured to block fluid flow through the main and secondary fluid pathways. The dissolvable layer is operable to be dissolved by a dissolution solvent downhole to allow fluid flow through the main and secondary fluid pathways. A viscosity discriminator is disposed within the fluid control module. The viscosity discriminator has a viscosity sensitive channel that forms at least a portion of the secondary fluid pathway. A differential pressure switch is operable to shift the valve element between the open and closed positions. The differential pressure switch includes a first pressure signal from the upstream side, a second pressure signal from the downstream side and a third pressure signal from the secondary fluid pathway. The first and second pressure signals bias the valve element toward the open position while the third pressure signal biases the valve element toward the closed position. The magnitude of the third pressure signal is dependent upon the viscosity of the fluid flowing through the secondary fluid pathway such that the differential pressure switch is operated responsive to changes in the viscosity of the fluid, thereby controlling fluid flow through the main fluid pathway.

In a ninth aspect, the present disclosure is directed to a downhole fluid flow control method including positioning a fluid flow control system at a target location downhole, the fluid flow control system including a fluid control module having an upstream side, a downstream side and a main fluid pathway in parallel with a secondary fluid pathway each extending between the upstream and downstream sides, a viscosity discriminator and a differential pressure switch, the viscosity discriminator having a viscosity sensitive channel that forms at least a portion of the secondary fluid pathway; preventing fluid flow through the main and secondary fluid pathways with a dissolvable layer disposed on an interior surface of the fluid control module; exposing the dissolvable layer to a dissolution solvent downhole to allow fluid flow through the main and secondary fluid pathways; producing a desired fluid from the upstream side to the downstream side through the fluid control module; operating the differential pressure switch to shift the valve element to the open position responsive to producing the desired fluid by applying a first pressure signal from the upstream side to a first area of the valve element, a second pressure signal from the downstream side to a second area of the valve element and a third pressure signal from the secondary fluid pathway to a third area of the valve element; producing an undesired fluid from the upstream side to the downstream side through the fluid control module; and operating the differential pressure switch to shift the valve element to the closed position responsive to producing the undesired fluid by applying the first pressure signal to the first area of the valve element, the second pressure signal to the second area of the valve element and the third pressure signal to the third area of the valve element; wherein, a magnitude of the third pressure signal is dependent upon the viscosity of a fluid flowing through the secondary fluid pathway such that the viscosity of the fluid operates the differential pressure switch, thereby controlling fluid flow through the main fluid pathway.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, and the like described herein may be positioned in any desired orientation. Thus, the use of terms such as "above," "below," "upper," "lower" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the term "coupled" may include direct or indirect coupling by any means, including moving and/or non-moving mechanical connections.

Figure 1:
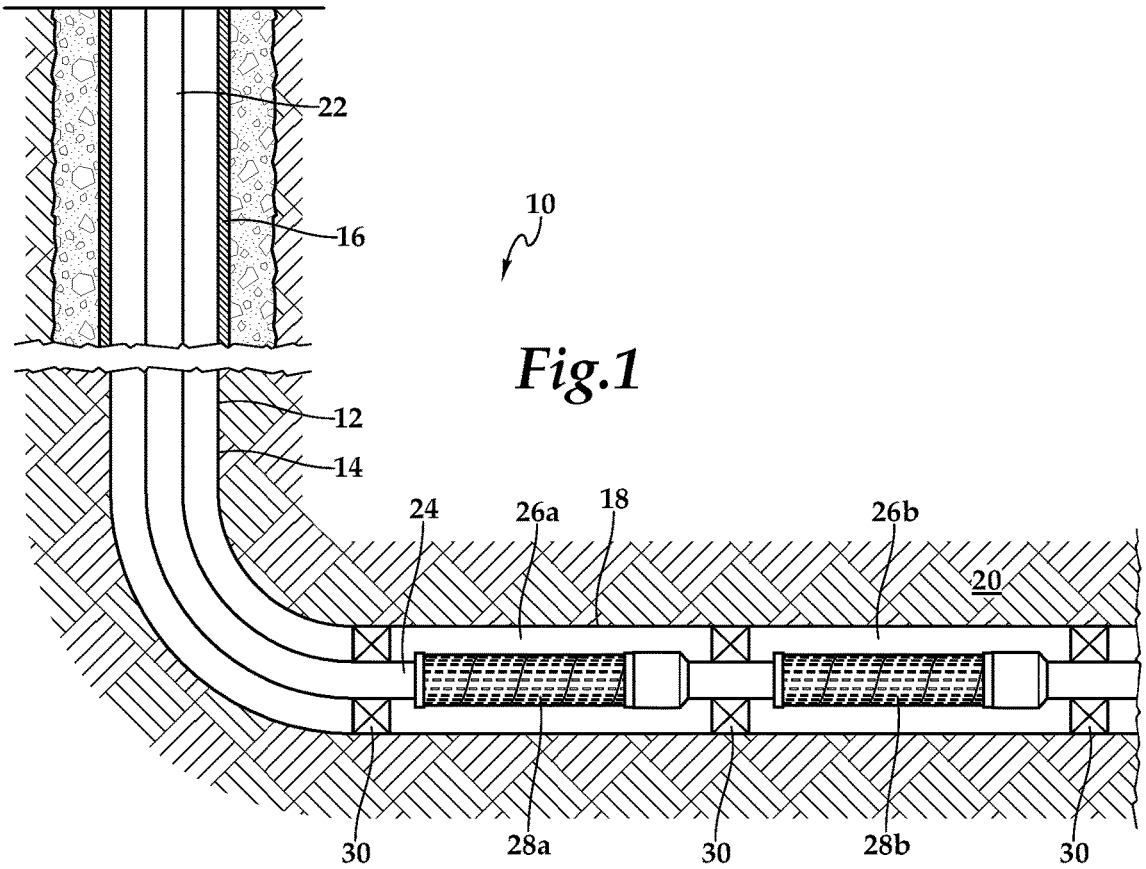
FIG. 1 is a schematic illustration of a well system operating a plurality of flow control screens according to embodiments of the present disclosure.

Referring initially to FIG. 1, therein is depicted a well system including a plurality of downhole fluid flow control systems positioned in flow control screens embodying principles of the present disclosure that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and/or for injection fluids to travel from the surface to formation 20. At its lower end, tubing string 22 is coupled to a completion string 24 that has been installed in wellbore 12 and divides the completion interval into various production intervals such as production intervals 26*a*, 26*b* that are adjacent to formation 20. Completion string 24 includes a plurality of flow control screens 28*a*, 28*b*, each of which is positioned between a pair of annular barriers depicted as packers 30 that provide a fluid seal between completion string 24 and wellbore 12, thereby defining production intervals 26*a*, 26*b*. In the illustrated embodiment, flow control screens 28*a*, 28*b* serve the function of filtering particulate matter out of the production fluid stream as well as providing autonomous flow control of fluids flowing therethrough utilizing viscosity dependent differential pressure switches.

For example, the flow control sections of flow control screens 28*a*, 28*b* may be operable to control the inflow of a production fluid stream during the production phase of well operations. Alternatively or additionally, the flow control sections of flow control screens 28*a*, 28*b* may be operable to control the flow of an injection fluid stream during a treatment phase of well operations. As explained in greater detail below, the flow control sections preferably control the inflow of production fluids from each production interval without the requirement for well intervention as the composition of the fluids produced into specific intervals changes over time in order to maximize production of desired fluid and minimize production of undesired fluid. For example, the present flow control screens may be tuned to maximize the production of oil and minimize the production of water. As another example, the present flow control screens may be tuned to maximize the production of gas and minimize the production of water. In yet another example, the present flow control screens may be tuned to maximize the production of oil and minimize the production of gas. Importantly, the flow control sections of the present disclosure have high sensitivity to viscosity changes in a production fluid such that the flow control sections are able, for example, to discriminate between light crude oil and water.

Even though FIG. 1 depicts the flow control screens of the present disclosure in an open hole environment, it should be understood by those skilled in the art that the present flow control screens are equally well suited for use in cased wells. Also, even though FIG. 1 depicts one flow control screen in each production interval, it should be understood by those skilled in the art that any number of flow control screens may be deployed within a production interval without departing from the principles of the present disclosure. In addition, even though FIG. 1 depicts the flow control screens in a horizontal section of the wellbore, it should be understood by those skilled in the art that the present flow control screens are equally well suited for use in wells having other directional configurations including vertical wells, deviated wells, slanted wells, multilateral wells and the like. Further, even though the flow control systems in FIG. 1 have been described as being associated with flow control screens in a tubular string, it should be understood by those skilled in the art that the flow control systems of the present disclosure need not be associated with a screen or be deployed as part of the tubular string. For example, one or more flow control systems may be deployed and removably inserted into the center of the tubing string or inside pockets of the tubing string.

Figure 2:
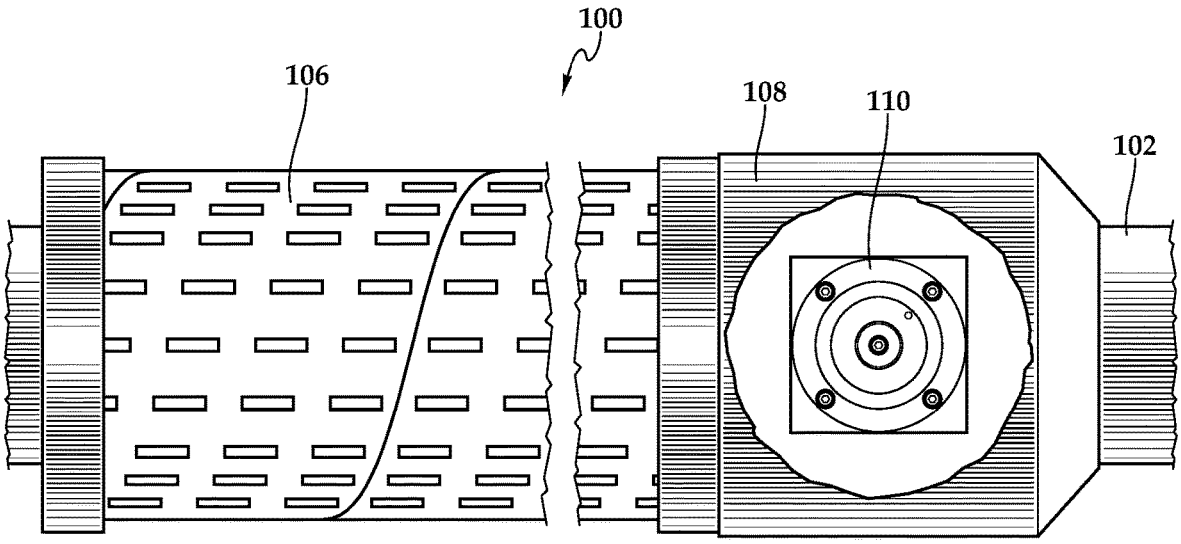
FIG. 2 is a top view of a flow control screen including a downhole fluid flow control system according to embodiments of the present disclosure.

Referring next to FIG. 2, therein is depicted a flow control screen according to the present disclosure that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that preferably has a blank pipe section disposed to the interior of a screen element or filter medium 106, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the embodiments of the present disclosure not need have a filter medium associated therewith, accordingly, the exact design of the filter medium is not critical to the present disclosure.

Fluid produced through filter medium 106 travels toward and enters an annular area between outer housing 108 and base pipe 102. To enter the interior of base pipe 102, the fluid must pass through a fluid control module 110, seen through the cutaway section of outer housing 108, and a perforated section of base pipe 102, not visible, disposed to the interior of fluid control module 110. The flow control system of each flow control screen 100 may include one or more fluid control modules 110. In certain embodiments, fluid control modules 110 may be circumferentially distributed about base pipe 102 such as at 180 degree intervals, 120 degree intervals, 90 degree intervals or other suitable distribution. Alternatively or additionally, fluid control modules 110 may be longitudinally distributed along base pipe 102. Regardless of the exact configuration of fluid control modules 110 on base pipe 102, any desired number of fluid control modules 110 may be incorporated into a flow control screen 100, with the exact configuration depending upon factors that are known to those skilled in the art including the reservoir pressure, the expected composition of the production fluid, the expected production rate and the like. The various connections of the components of flow control screen 100 may be made in any suitable fashion including welding, threading and the like as well as through the use of fasteners such as pins, set screws and the like. Even though fluid control module 110 has been described and depicted as being coupled to the exterior of base pipe 102, it will be understood by those skilled in the art that the fluid control modules of the present disclosure may be alternatively positioned such as within openings of the base pipe or to the interior of the base pipe so long as the fluid control modules are positioned between the upstream or formation side and the downstream or base pipe interior side of the formation fluid path.

Fluid control modules 110 may be operable to control the flow of fluid in both the production direction and the injection direction therethrough. For example, during the production phase of well operations, fluid flows from the formation into the production tubing through fluid flow control screen 100. The production fluid, after being filtered by filter medium 106, if present, flows into the annulus between base pipe 102 and outer housing 108. The fluid then enters one or more inlets of fluid control modules 110 where the desired flow operation occurs depending upon the viscosity and/or the density of the produced fluid. For example, if a desired fluid such as oil is produced, flow through a main flow pathway of fluid control module 110 is allowed. If an undesired fluid such as water is produced, flow through the main flow pathway of fluid control module 110 is restricted or prevented. In the case of producing a desired fluid, the fluid is discharged through fluid control modules 110 to the interior flow path of base pipe 102 for production to the surface. As another example, during the treatment phase of well operations, a treatment fluid may be pumped downhole from the surface in the interior flow path of base pipe 102. In this case, the treatment fluid then enters fluid control modules 110 where the desired flow control operation occurs including opening the main flow pathway. The fluid then travels into the annulus between base pipe 102 and outer housing 108 before injection into the surrounding formation.

Figure 3A:
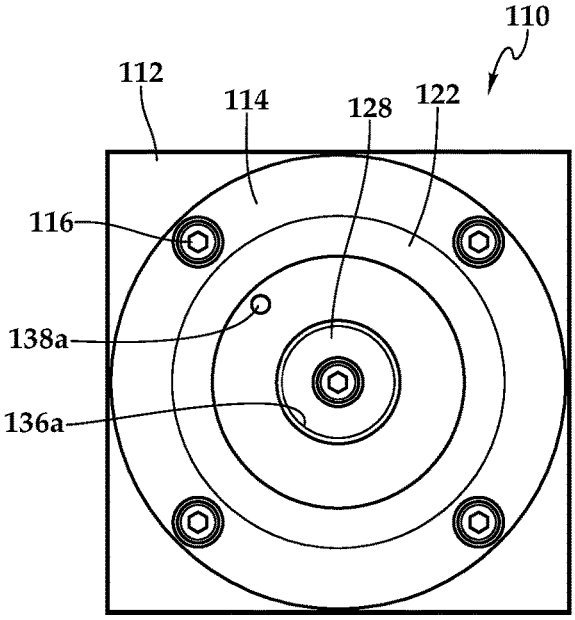
FIGS. 3A-3D are various views of a downhole fluid flow control system according to embodiments of the present disclosure.
Figure 3B:
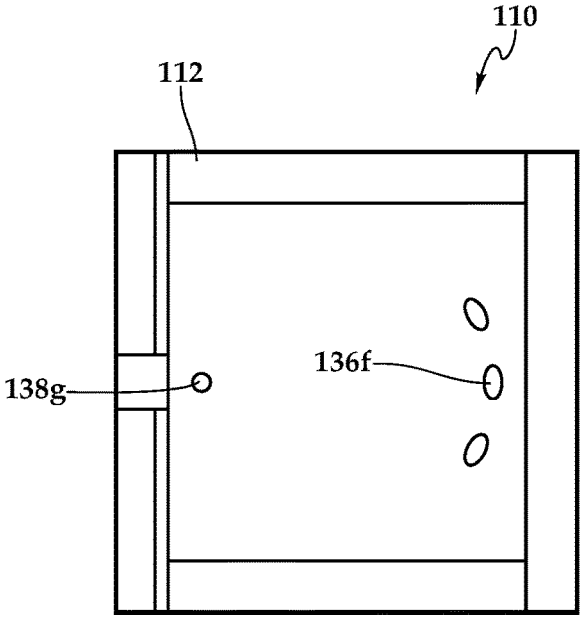
Figure 3C:
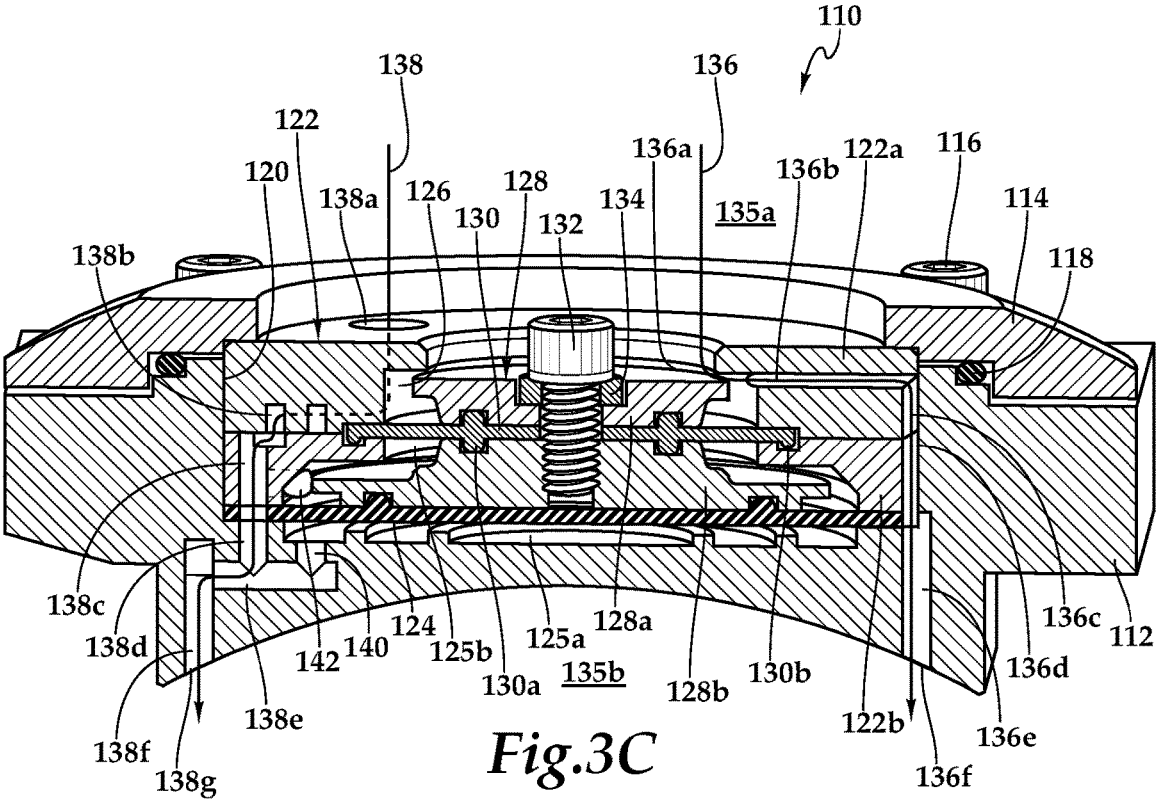
Figure 3D:
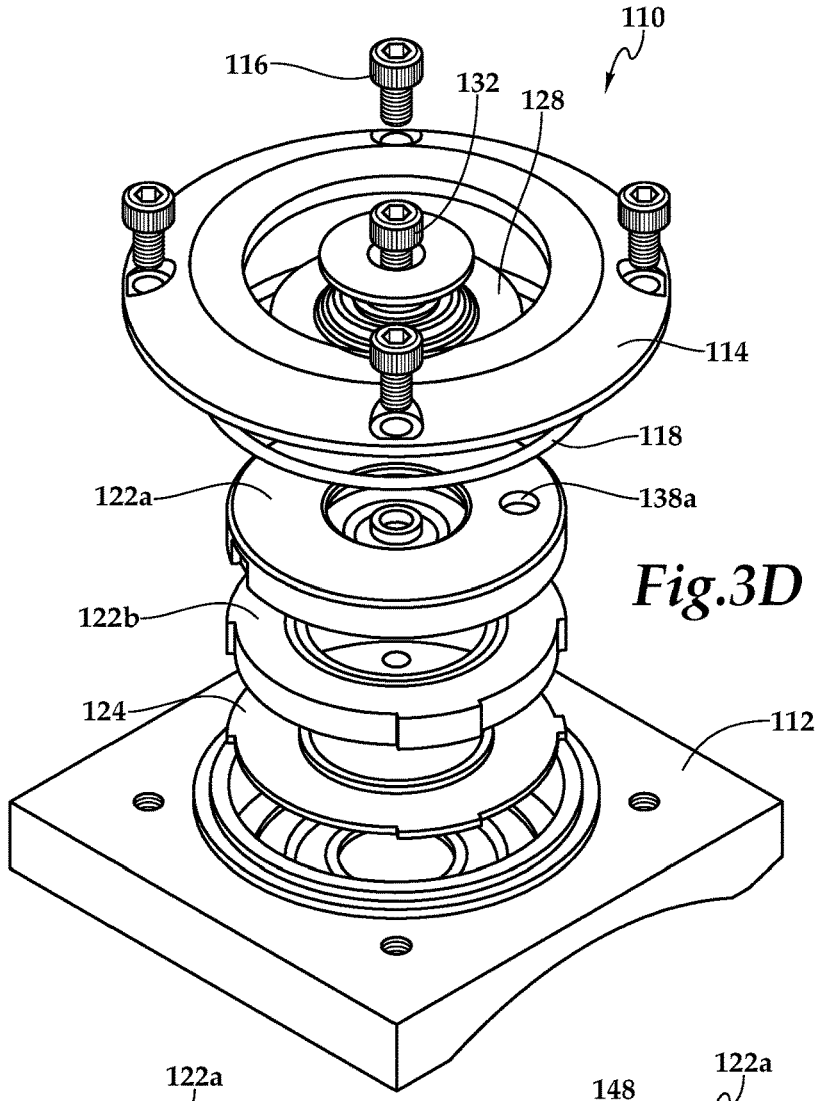

Referring next to FIGS. 3A-3D, a fluid control module for use in a downhole fluid flow control system of the present disclosure is representatively illustrated and generally designated 110. Fluid control module 110 includes a housing member 112 and a housing cap 114 that are coupled together with a plurality of bolts 116. An O-ring seal 118 is disposed between housing member 112 and housing cap 114 to provide a fluid seal therebetween. As best seen in FIG. 3C, housing member 112 defines a generally cylindrical cavity 120. In the illustrated embodiment, a viscosity discriminator disk 122 is closely received within cavity 120. Viscosity discriminator disk 122 includes an upper viscosity discriminator plate 122*a* and a lower viscosity discriminator plate 122*b*. A generally cylindrical seal element 124 is disposed between a lower surface of lower viscosity discriminator plate 122*b* and a lower chamber 125*a* of housing member 112.

As best seen in FIG. 3C, viscosity discriminator disk 122 defines a generally cylindrical cavity 126 having a contoured and stepped profile. In the illustrated embodiment, a valve element 128 is received within cavity 126. Valve element 128 includes an upper valve plate 128*a* and a lower valve plate 128*b*. A generally cylindrical seal element 130 is disposed between upper valve plate 128*a* and lower valve plate 128*b*. In addition, a radially outer portion of seal element 130 is disposed between upper viscosity discriminator plate 122*a* and lower viscosity discriminator plate 122*b*. In the illustrated embodiment, an inner ring 130*a* of seal element 130 is received within glands of upper valve plate 128*a* and lower valve plate 128*b*. An outer ring 130*b* of seal element 130 is received within a gland of lower viscosity discriminator plate 122*b*. Upper valve plate 128*a*, lower valve plate 128*b* and seal element 130 are coupled together with a bolt 132 and washer 134 such that upper valve plate 128*a* and lower valve plate 128*b* act as a signal valve element 128.

Fluid control module 110 includes a main fluid pathway extending between an upstream side 135*a* and a downstream side of 135*b* of fluid control module 110 illustrated along streamline 136 in FIG. 3C. In the illustrated embodiment, main fluid pathway 136 includes an inlet 136*a* between a lower surface of upper viscosity discriminator plate 122*a* and an upper surface of valve element 128. Main fluid pathway 136 also includes three radial pathways 136*b* (only one being visible in FIG. 3C) that extend through upper viscosity discriminator plate 122*a*, three longitudinal pathways 136*c* (only one being visible in FIG. 3C) that extend through upper viscosity discriminator plate 122*a*, three longitudinal pathways 136*d* (only one being visible in FIG. 3C) that extend through lower viscosity discriminator plate 122*b* and three longitudinal pathways 136*e* (only one being visible in FIG. 3C) that extend through housing member 112. As best seen in FIG. 3B, main fluid pathway 136 includes three outlets 136*f*. Even though main fluid pathway 136 has been depicted and described as having a particular configuration with a particular number of pathways, it should be understood by those skilled in the art that a main fluid pathway of the present disclosure may have a variety of designs with any number of pathways, branches and/or outlets both greater than or less than three as long as the main fluid pathway provides a fluid path between the upstream and downstream sides of the fluid control module.

Fluid control module 110 includes a secondary fluid pathway extending between upstream side 135*a* and downstream side of 135*b* of fluid control module 110 illustrated as streamline 138 in FIG. 3C. In the illustrated embodiment, secondary fluid pathway 138 includes an inlet 138*a* in upper viscosity discriminator plate 122*a*. Secondary fluid pathway 138 also includes a viscosity sensitive channel 138*b* that extends through upper viscosity discriminator plate 122*a*, a longitudinal pathway 138*c* that extends through lower viscosity discriminator plate 122*b*, a longitudinal pathway 138*d* that extend through housing member 112, a radial pathway 138*e* that extend through housing member 112 and a longitudinal pathway 138*f* that extend through housing member 112. As best seen in FIG. 3B, secondary fluid pathway 138 includes an outlet 138*g*. Secondary fluid pathway 138 is in fluid communication with lower chamber 125*a* via a pressure port 140 that is in fluid communication with radial pathway 138*e*. In the illustrated embodiment, pressure port 140 intersect secondary fluid pathway 138 at a location downstream of viscosity sensitive channel 138*b*. In other embodiments, pressure port 140 could intersect secondary fluid pathway 138 at a location upstream of viscosity sensitive channel 138*b* or other suitable location along secondary fluid pathway 138. Fluid control module 110 includes a pressure port 142 that extends through lower viscosity discriminator plate 122*b* and housing member 112 to provide fluid communication between downstream side of 135*b* and an upper chamber 125*b* defined between seal element 124 and seal element 130. The fluid flowrate ratio between main fluid pathway 136 and the secondary fluid pathway 138 may be between about 3 to 1 and about 10 to 1 or higher and is preferably greater than 4 to 1 when main fluid pathway 136 is open.

Figure 4A:
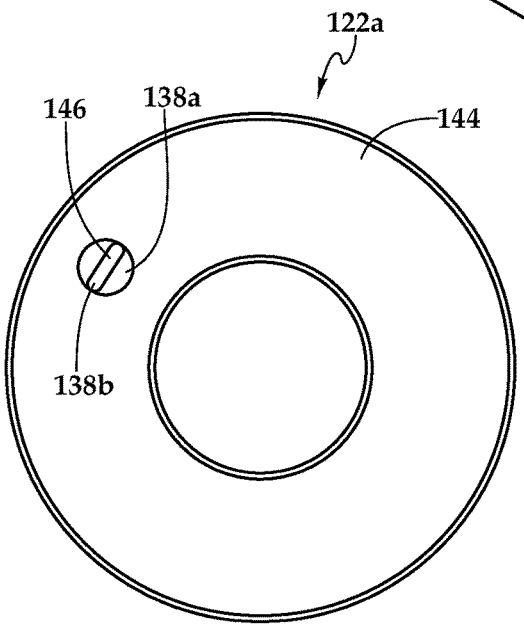
FIGS. 4A-4B are top and bottom views of a viscosity discriminator plate for a downhole fluid flow control system according to embodiments of the present disclosure.
Figure 4B:
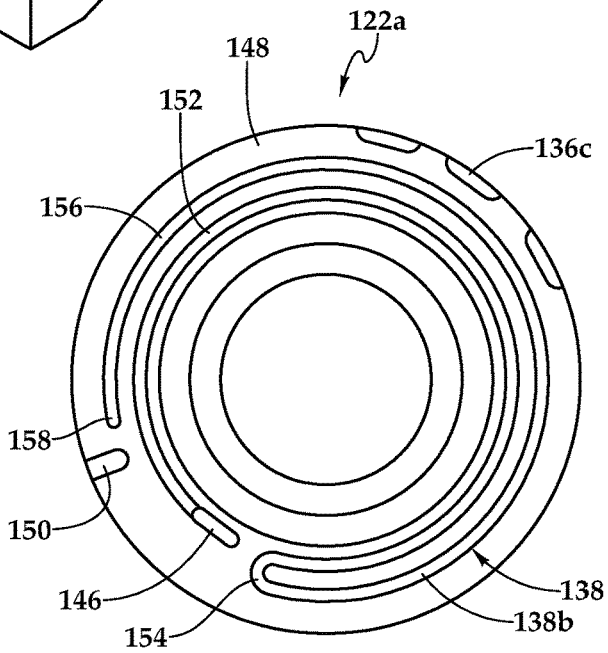

Referring additionally to FIGS. 4A-4B, an exemplary upper viscosity discriminator plate 122*a* of a viscosity discriminator 122 is depicted. As best seen in FIG. 4A, an upper surface 144 of upper viscosity discriminator plate 122*a* includes inlet 138*a* of secondary fluid pathway 138. Inlet 138*a* is aligned with a beginning portion 146 of viscosity sensitive channel 138*b*. As best seen in FIG. 4B, a lower surface 148 of upper viscosity discriminator plate 122*a* includes three longitudinal pathways 136*c* of main fluid pathway 136 and an alignment notch 150 that mates with a lug of lower viscosity discriminator plate 122*b* to assure that upper viscosity discriminator plate 122*a* and lower viscosity discriminator plate 122*b* are properly oriented relative to each other. Lower surface 148 also includes viscosity sensitive channel 138*b* of secondary fluid pathway 138. In the illustrated embodiment, viscosity sensitive channel 138*b* includes beginning portion 146, an inner circumferential path 152, a turn depicted as reversal of direction path 154, an outer circumferential path 156 and an end portion 158. End portion 158 is in fluid communication with longitudinal pathway 138*c* that extends through lower viscosity discriminator plate 122*b*.

Viscosity sensitive channel 138*b* provides a tortuous path for fluids traveling through secondary fluid pathway 138. In addition, viscosity sensitive channel 138*b* preferably has a characteristic dimension that is small enough to make the effect of the viscosity of the fluid flowing therethrough non-negligible. When a low viscosity fluid such as water is being produced, the flow through viscosity sensitive channel 138*b* may be turbulent having a Reynolds number in a range of 10,000 to 100,000 or higher. When a high viscosity fluid such as oil is being produced, the flow through viscosity sensitive channel 138*b* may be less turbulent or even laminar having a Reynolds number in a range of 1,000 to 10,000.

Even through upper viscosity discriminator plate 122*a* has been depicted and described as having a particular shape with a viscosity sensitive channel having a tortuous path with a particular orientation, it should understood by those having skill in the art that an upper viscosity discriminator plate of the present disclosure could have a variety of shapes and could have a tortuous path with a variety of different orientations. In addition, even though viscosity discriminator 122 has been depicted and described as having upper and lower viscosity discriminator plates, it should understood by those having skill in the art that a viscosity discriminator of the present disclosure may have other numbers of plates both less than and greater than two. Further, even though viscosity sensitive channel 138*b* has been depicted and described as being on a surface of a viscosity discriminator plate, it should understood by those having skill in the art that a viscosity sensitive channel could alternatively be formed within a viscosity discriminator, such as a viscosity discriminator formed from a signal component.

Figure 5A:
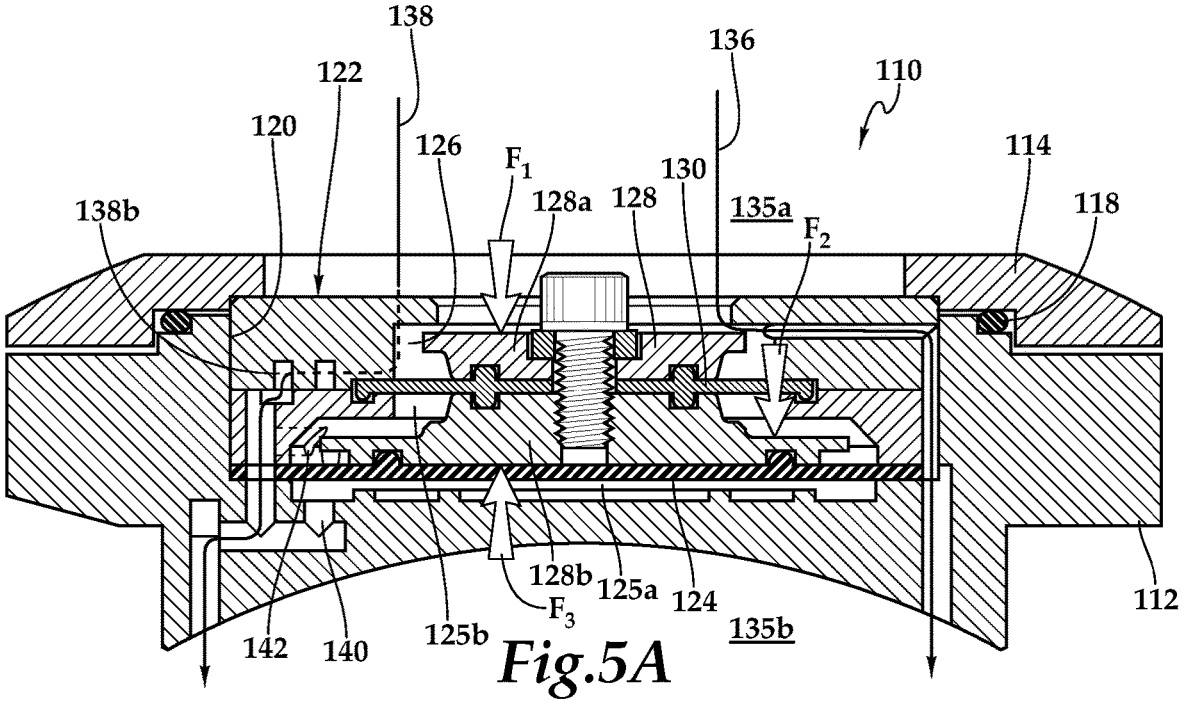
FIGS. 5A-5B are cross sectional views of a downhole fluid flow control module in an open position and a closed position, respectively, according to embodiments of the present disclosure.
Figure 5B:
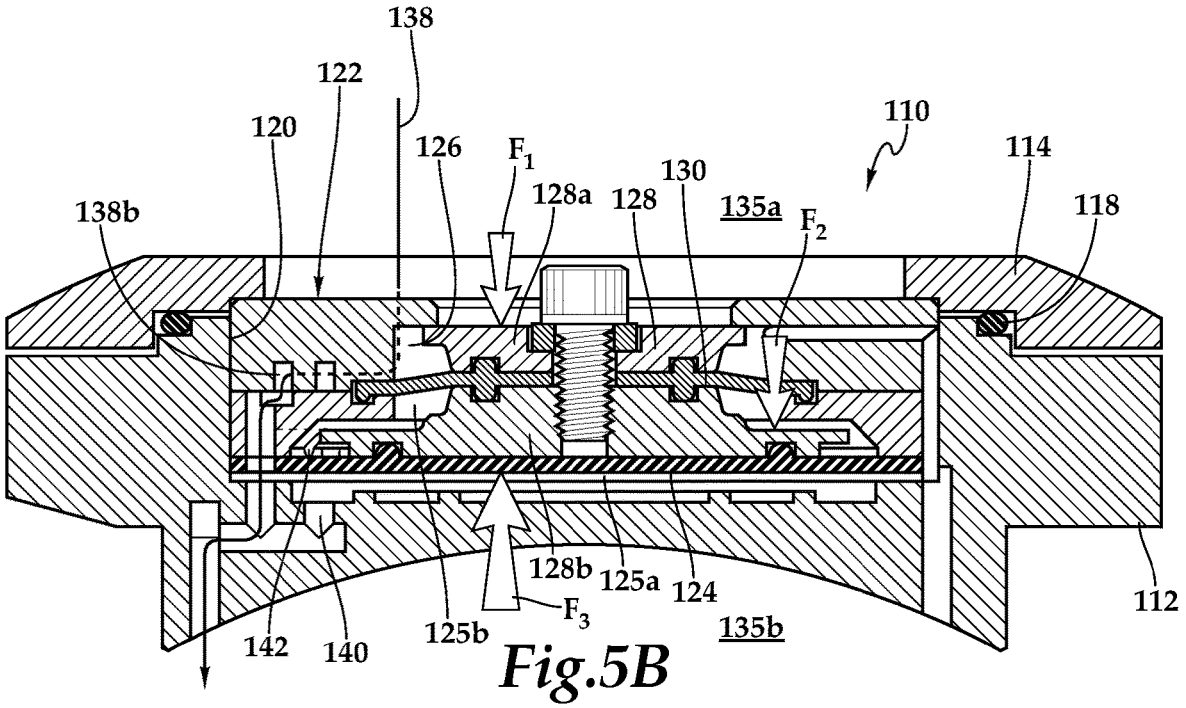

Referring next to FIGS. 5A-5B, a downhole fluid flow control module in its open and closed positions is representatively illustrated and generally designated 110. Fluid control module 110 has a housing member 112 and a housing cap 114 that are coupled together with a plurality of bolts (see FIG. 3C) with a seal element 118 therebetween. A viscosity discriminator 122 and a seal element 124 are disposed within a cavity 120 of housing member 112. A valve element 128 and a seal element 130 are disposed within a cavity 126 of viscosity discriminator 122. Fluid control module 110 defines a main fluid pathway 136 and a secondary fluid pathway 138 each extending between upstream side 135*a* and downstream side 135*b* of fluid control module 110. Viscosity discriminator 122 includes a viscosity sensitive channel 138*b* that forms a portion of secondary fluid pathway 138. In addition, viscosity discriminator 122 and housing member 112 form a pressure port 142 that provides fluid communication from downstream side 135*b* to an upper chamber 125*b*. A pressure port 140 in housing member 112 provides fluid communication from secondary fluid pathway 138 to lower chamber 125*a*.

As can be seen by comparing FIGS. 5A and 5B, valve element 128 is operable for movement within fluid control module 110 and is depicted in its fully open position in FIG. 5A and its fully closed position in FIG. 5B. It should be noted by those skilled in the art that valve element 128 also has a plurality of choking positions between the fully open and fully closed positions. Valve element 128 is operated between the open and closed positions responsive to a differential pressure switch. The differential pressure switch includes a pressure signal $P_1$ from upstream side 135*a* acting on an upper surface $A_1$ of upper valve plate 128*a* to generate a force $F_1$ that biases valve element 128 toward the open position. The differential pressure switch also includes a pressure signal $P_2$ from downstream side 135*b* via pressure port 142 acting on an upper surface $A_2$ of lower valve plate 128*b* to generate a force $F_2$ that biases valve element 128 toward the open position. In addition, the differential pressure switch includes a pressure signal $P_3$ from secondary fluid pathway 138 via pressure port 140 acting on a lower surface $A_3$ of valve element 128 to generate a force $F_3$ that biases valve element 128 toward the closed position.

As best seen in FIG. 5A, when $(P_1A_1)+(P_2A_2)>(P_3A_3)$ or $F_1+F_2>F_3$, valve element 128 is biased to the open position. This figure may represent a production scenario when a desired fluid having a high viscosity such as oil is being produced. As best seen in FIG. 5B, when $(P_1A_1)+(P_2A_2)<(P_3A_3)$ or $F_1+F_2<F_3$, valve element 128 is biased to the closed position. This figure may represent a production scenario when an undesired fluid having a low viscosity such as water is being produced. The differential pressure switch operates responsive to changes in the magnitude of the pressure signal $P_3$ from secondary fluid pathway 138 which determines the magnitude of $F_3$. The magnitude of pressure signal $P_3$ is established based upon the viscosity of the fluid traveling through secondary fluid pathway 138. More specifically, the tortuous path created by viscosity sensitive channel 138*b* has a different influence on high viscosity fluids, such as oil, compared to low viscosity fluids, such as water. For example, the tortuous path will have a greater influence relative to the velocity of high viscosity fluids traveling therethrough compared to the velocity of low viscosity fluids traveling therethrough, which results in a greater reduction in the dynamic pressure $P_D$ of high viscosity fluids compared to low viscosity fluids traveling through viscosity sensitive channel 138*b*. In this manner, using the fluid flow control system of the present disclosure having a viscosity dependent differential pressure switch enables autonomous operation of the valve element as the viscosity of a production fluid changes over the life of a well to enable production of a desired fluid, such as oil, though the main flow pathway while restricting or shutting off the production of an undesired fluid, such as water or gas, though the main flow pathway.

Figure 6A:
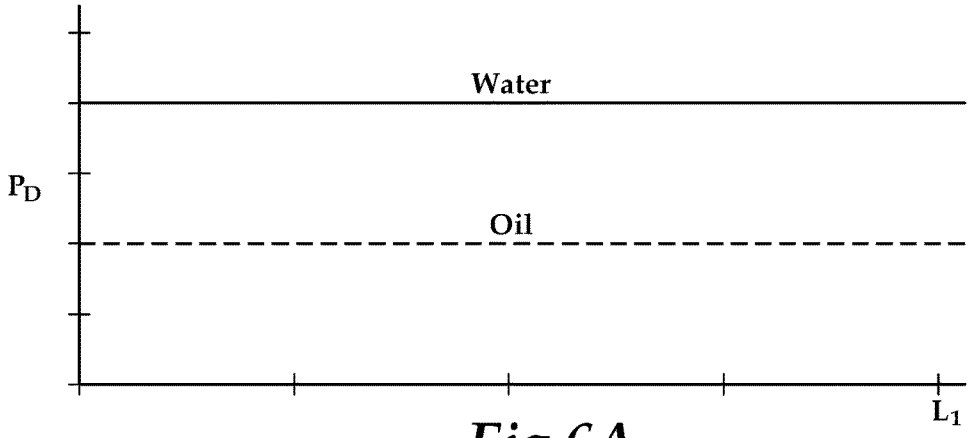
FIGS. 6A-6C are pressure versus distance graphs depicting the influence of a viscosity sensitive channel on fluids traveling therethrough according to embodiments of the present disclosure.
Figure 6B:
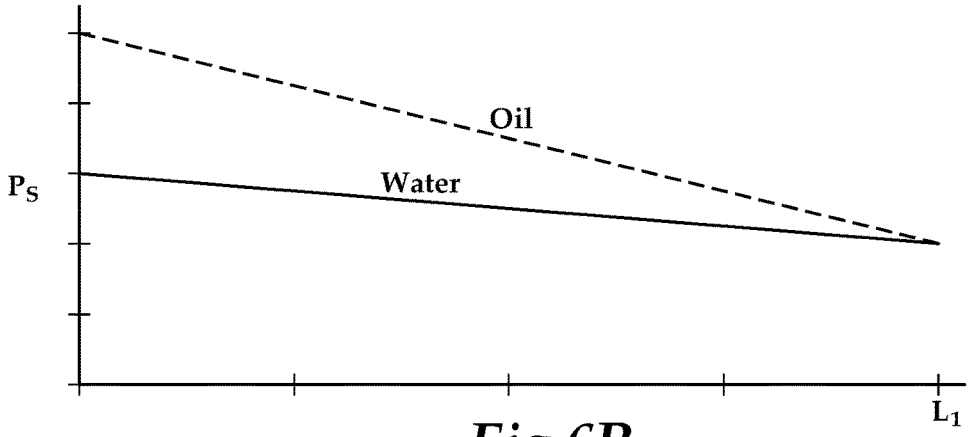
Figure 6C:
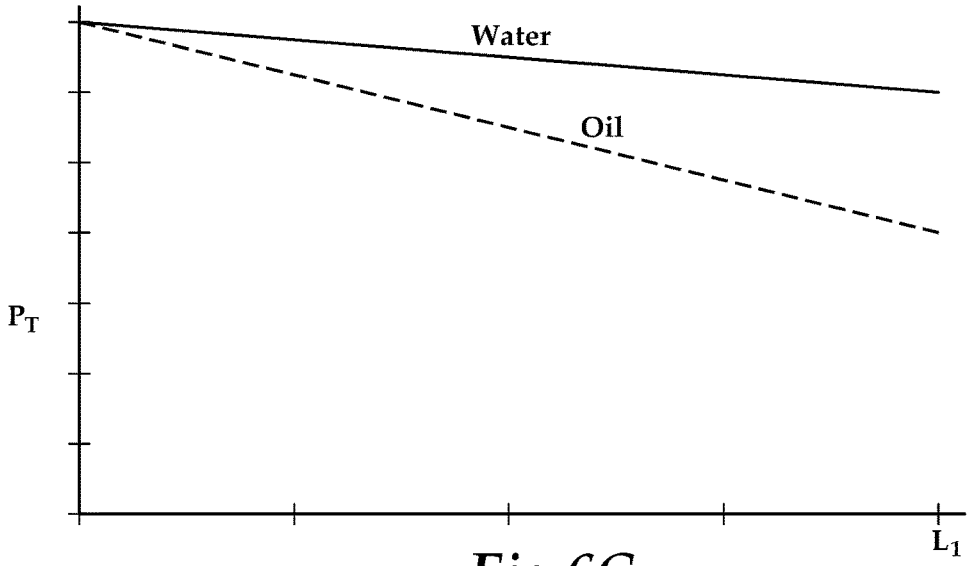

According to Bernoulli's principle, the sum of the static pressure $P_S$, the dynamic pressure $P_D$ and a gravitation term is a constant and is referred to herein as the total pressure $P_T$. In the present case, the gravitational term is negligible due to low elevation change. FIG. 6A is a pressure versus distance graph illustrating the influence of the tortuous path on the dynamic pressure $P_D$ of a high viscosity fluid compared to a low viscosity fluid traveling through viscosity sensitive channel 138*b*. FIG. 6B is a pressure versus distance graph illustrating the influence of the tortuous path on the static pressure $P_S$ of a high viscosity fluid compared to a low viscosity fluid traveling through viscosity sensitive channel 138*b*. FIG. 6C is a pressure versus distance graph illustrating the influence of the tortuous path on the total pressure $P_T$ of a high viscosity fluid compared to a low viscosity fluid traveling through viscosity sensitive channel 138*b*. In the graphs, it is assumed that in both the high viscosity fluid and the low viscosity fluid cases, the pressure at upstream side 135*a* is constant and the pressure at downstream side 135*b* is constant. As best seen in FIG. 6C, the total pressure $P_T$ of the high viscosity fluid proximate a downstream location of viscosity sensitive channel 138*b* is less than the total pressure $P_T$ of the low viscosity fluid at the same location, such as location $L_1$ in the graph. Thus, the magnitude of pressure signal $P_3$ taken at a location downstream of viscosity sensitive channel 138*b* for a high viscosity fluid will be less than the magnitude of pressure signal $P_3$ taken at the same location for a low viscosity fluid. This difference in magnitude of pressure signal $P_3$ is sufficient to trigger the differential pressure switch to shift valve element 128 between the open position when a high viscosity fluid, such as oil, is flowing and the closed position when low viscosity fluid, such as water, is flowing.

Figure 7A:
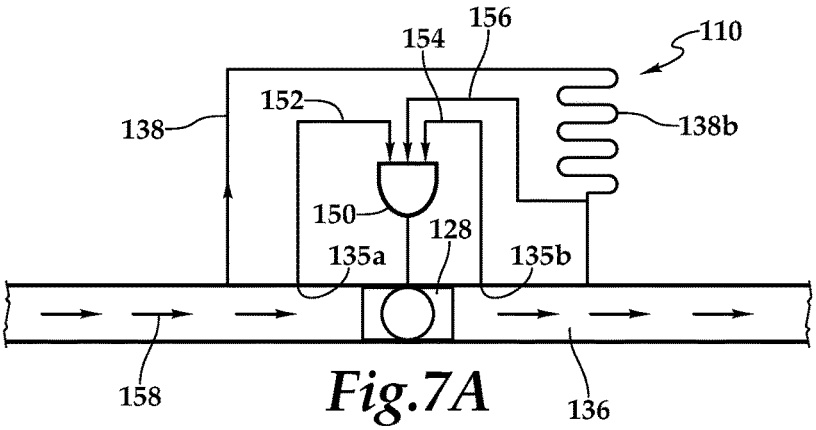
FIGS. 7A-7B are schematic illustrations of a downhole fluid flow control module according to embodiments of the present disclosure.
Figure 7B:
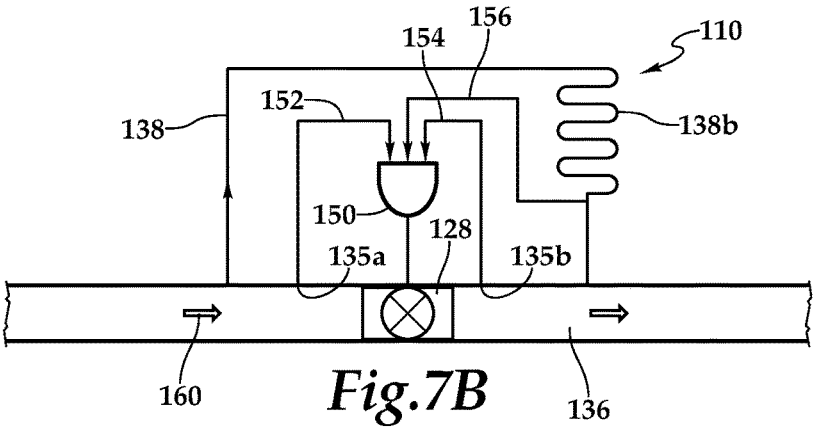

Referring next to FIGS. 7A-7B, a downhole fluid flow control module 110 is represented as a circuit diagram. Fluid control module 110 includes main fluid pathway 136 having a valve element 128 disposed therein. Fluid control module 110 also includes secondary fluid pathway 138 having viscosity sensitive channel 138*b*. Fluid control module 110 further includes a differential pressure switch 150 including a pressure signal 152 from upstream side 135*a* biasing valve element 128 to the open position, a pressure signal 154 from downstream side 135*b* biasing valve element 128 to the open position and a pressure signal 156 from secondary fluid pathway 138 biasing valve element 128 to the closed position.

In FIG. 7A, a high viscosity fluid, such as oil, is being produced through fluid control module 110 and is represented by solid arrows 158. As discussed herein, viscosity sensitive channel 138*b* has a large influence on the velocity of a high viscosity fluid flowing therethrough such that the magnitude of pressure signal 156 will cause differential pressure switch 150 to operate valve element 128 to the open position, as indicated by the high volume of arrows 158 passing through fluid control module 110. In FIG. 7B, a low viscosity fluid, such as water, is being produced through fluid control module 110 and is represented by hollow arrows 160. As discussed herein, viscosity sensitive channel 138*b* has a small influence on the velocity of a low viscosity fluid flowing therethrough such that the magnitude of pressure signal 156 will cause differential pressure switch 150 to operate valve element 128 to the closed position, as indicated by the low volume of arrows 160 passing through fluid control module 110, which may represent flow passing only through secondary fluid pathway 138. In the illustrated embodiment, pressure signal 156 is a total pressure $P_T$ signal taken at a location downstream of viscosity sensitive channel 138*b*.

Figure 8A:
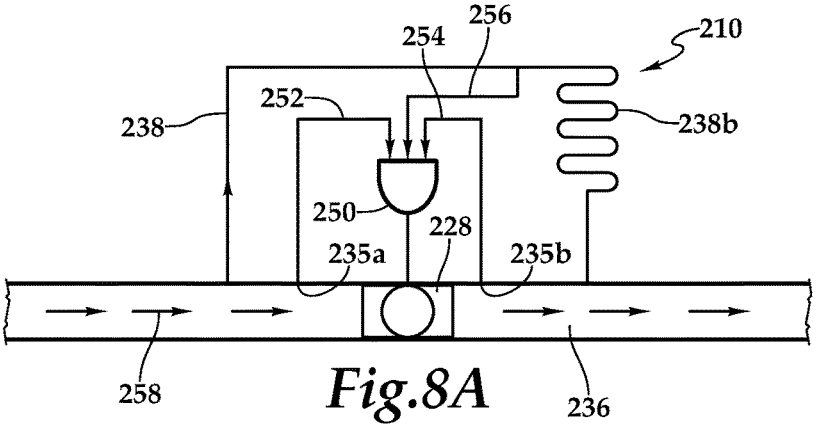
FIGS. 8A-8B are schematic illustrations of a downhole fluid flow control module according to embodiments of the present disclosure.
Figure 8B:
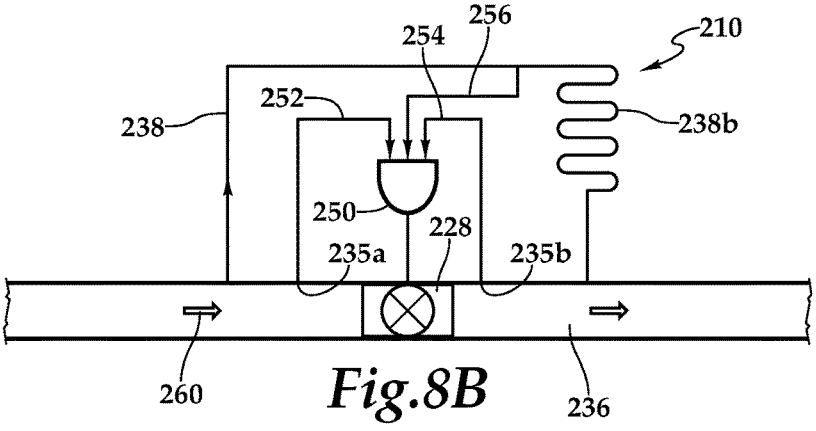

Referring next to FIGS. 8A-8B, a downhole fluid flow control module 210 is represented as a circuit diagram. Fluid control module 210 includes main fluid pathway 236 having a valve element 228 disposed therein. Fluid control module 210 also includes secondary fluid pathway 238 having viscosity sensitive channel 238*b*. Fluid control module 210 further includes a differential pressure switch 250 including a pressure signal 252 from upstream side 235*a* biasing valve element 228 to the open position, a pressure signal 254 from downstream side 235*b* biasing valve element 228 to the open position and a pressure signal 256 from secondary fluid pathway 238 biasing valve element 228 to the closed position.

In FIG. 8A, a high viscosity fluid, such as oil, is being produced through fluid control module 210 and is represented by solid arrows 258. As discussed herein, viscosity sensitive channel 238*b* has a large influence on the velocity of a high viscosity fluid flowing therethrough such that the magnitude of pressure signal 256 will cause differential pressure switch 250 to operate valve element 228 to the open position, as indicated by the high volume of arrows 258 passing through fluid control module 210. In FIG. 8B, a low viscosity fluid, such as water, is being produced through fluid control module 210 and is represented by hollow arrows 260. As discussed herein, viscosity sensitive channel 238*b* has a small influence on the velocity of a low viscosity fluid flowing therethrough such that the magnitude of pressure signal 256 will cause differential pressure switch 250 to operate valve element 228 to the closed position, as indicated by the low volume of arrows 260 passing through fluid control module 210, which may represent flow passing only through secondary fluid pathway 238. In the illustrated embodiment, pressure signal 256 is a static pressure $P_S$ signal taken at a location upstream of viscosity sensitive channel 238*b*.

Figure 9A:
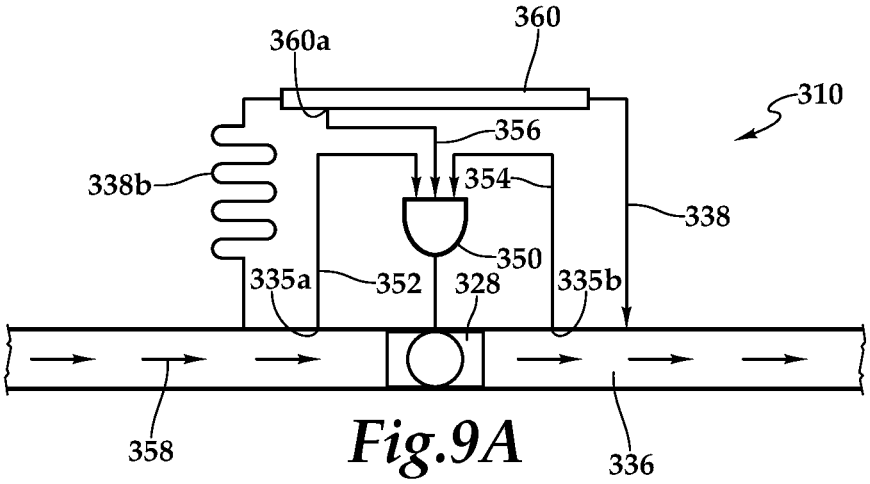
FIGS. 9A-9C are schematic illustrations of a downhole fluid flow control module according to embodiments of the present disclosure.
Figure 9B:
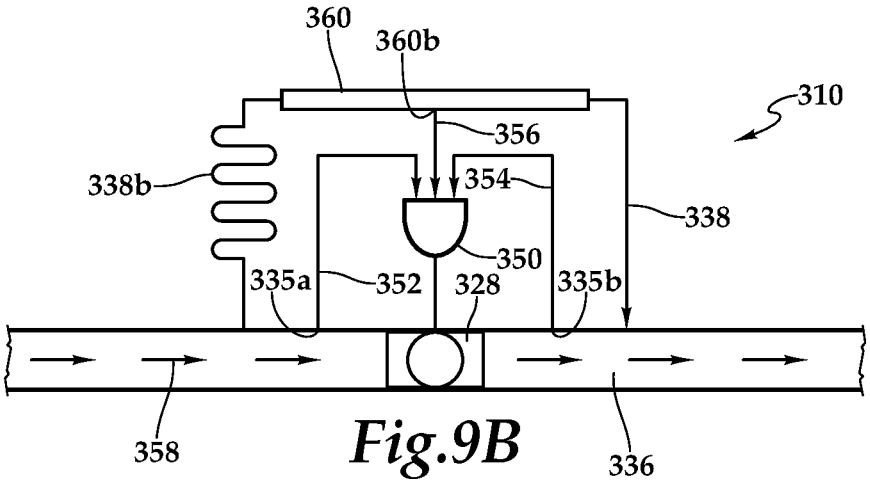
Figure 9C:
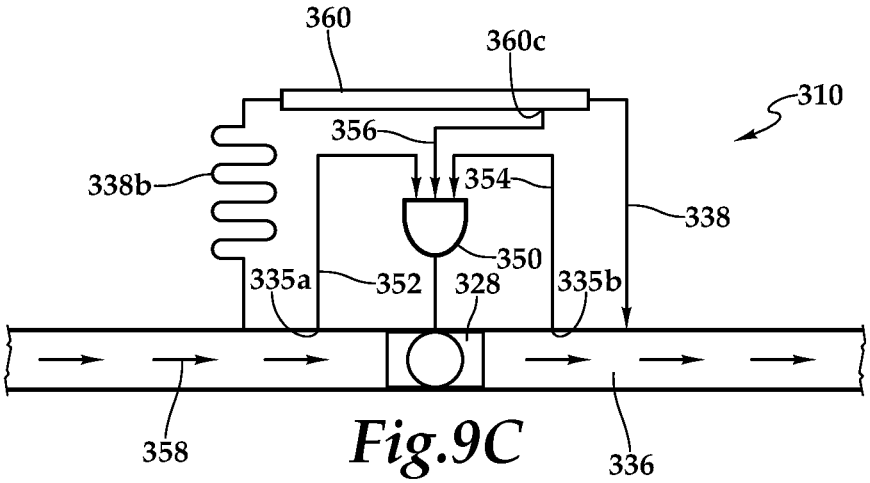

Referring next to FIGS. 9A-9C, a downhole fluid flow control module 310 is represented as a circuit diagram. Fluid control module 310 includes main fluid pathway 336 having a valve element 328 disposed therein. Fluid control module 310 also includes secondary fluid pathway 338 having viscosity sensitive channel 338*b* and a non viscosity sensitive channel 360. Fluid control module 310 further includes a differential pressure switch 350 including a pressure signal 352 from upstream side 335*a* biasing valve element 328 to the open position, a pressure signal 354 from downstream side 335*b* biasing valve element 328 to the open position and a pressure signal 356 from secondary fluid pathway 338 biasing valve element 328 to the closed position.

In FIG. 9A, a high viscosity fluid, such as oil, is being produced through fluid control module 310 and is represented by solid arrows 358. As discussed herein, viscosity sensitive channel 338*b* has a large influence on the velocity of a high viscosity fluid flowing therethrough such that the magnitude of pressure signal 356 will cause differential pressure switch 350 to operate valve element 328 to the open position, as indicated by the high volume of arrows 358 passing through fluid control module 310. In the illustrated embodiment, pressure signal 356 is a total pressure $P_T$ signal taken downstream of viscosity sensitive channel 338*b* and from an upstream location 360*a* of non viscosity sensitive channel 360. In FIG. 9B, pressure signal 356 is a total pressure $P_T$ signal taken downstream of viscosity sensitive channel 338*b* and from a midstream location 360*b* of non viscosity sensitive channel 360. In FIG. 9C, pressure signal 356 is a total pressure $P_T$ signal taken downstream of viscosity sensitive channel 338*b* and from a downstream location 360*c* of non viscosity sensitive channel 360. Use of the non viscosity sensitive channel 360 in combination with viscosity sensitive channel 338*b* in secondary fluid pathway 338 enables flexibility in the design of flow control module 310. Similar to fluid control modules 110 and 210 described herein, when a low viscosity fluid, such as water, is being produced through fluid control module 310 viscosity sensitive channel 338*b* has a small influence on the velocity of a low viscosity fluid flowing therethrough such that the magnitude of pressure signal 356 will cause differential pressure switch 350 to operate valve element 328 to the closed position.

Figure 10A:
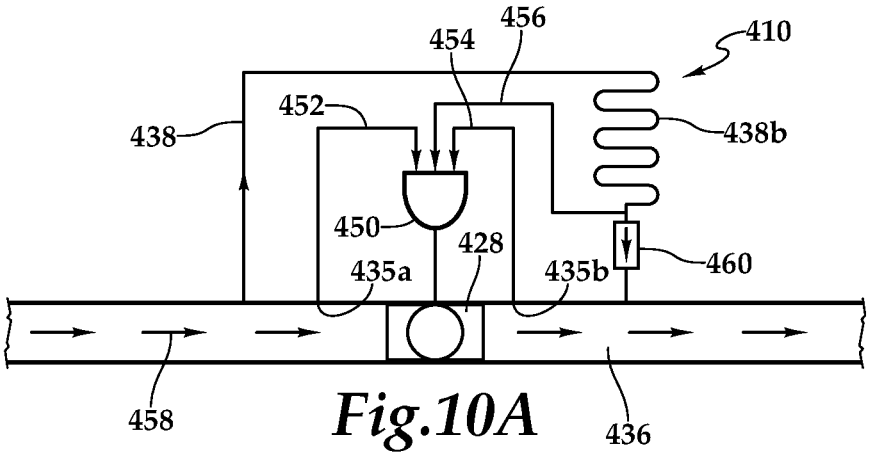
FIGS. 10A-10C are schematic illustrations of a downhole fluid flow control module according to embodiments of the present disclosure.
Figure 10B:
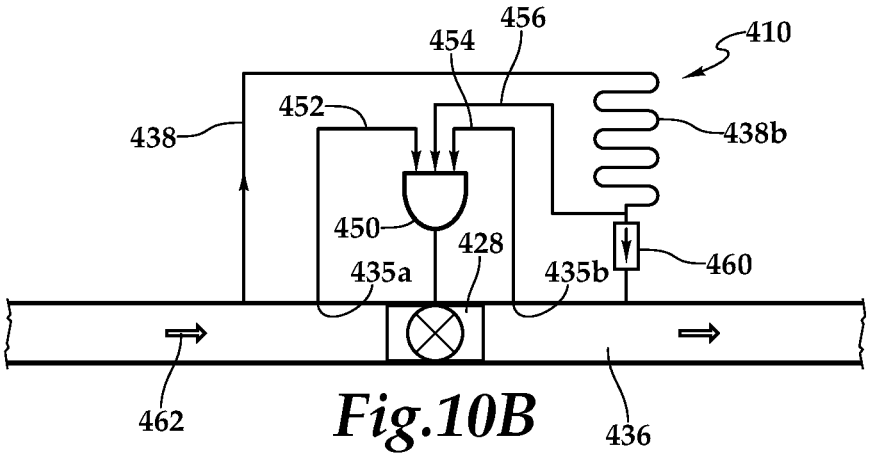
Figure 10C:
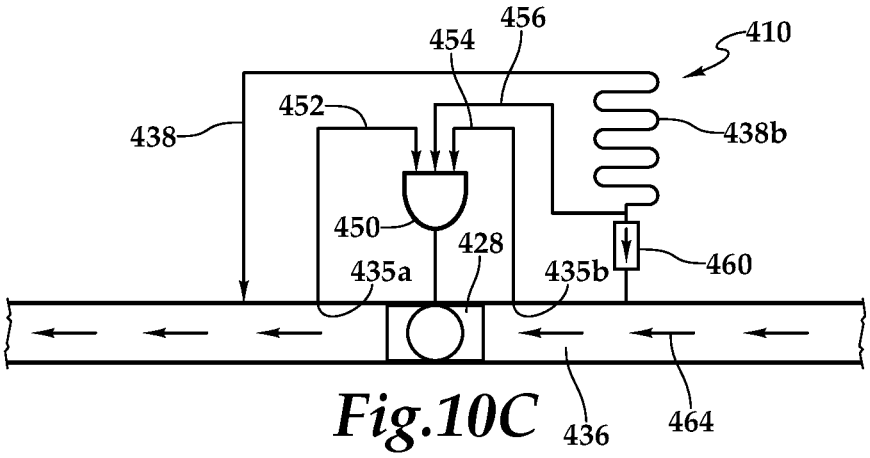

Referring next to FIGS. 10A-10C, a downhole fluid flow control module 410 is represented as a circuit diagram. Fluid control module 410 includes main fluid pathway 436 having a valve element 428 disposed therein. Fluid control module 410 also includes secondary fluid pathway 438 having viscosity sensitive channel 438*b* and a fluid diode having directional resistance depicted as tesla valve 460. Fluid control module 410 further includes a differential pressure switch 450 including a pressure signal 452 from upstream side 435*a* biasing valve element 428 to the open position, a pressure signal 454 from downstream side 435*b* biasing valve element 428 to the open position and a pressure signal 456 from secondary fluid pathway 438 biasing valve element 428 to the closed position.

In FIG. 10A, a high viscosity fluid, such as oil, is being produced through fluid control module 410 and is represented by solid arrows 458. As discussed herein, viscosity sensitive channel 438*b* has a large influence on the velocity of a high viscosity fluid flowing therethrough such that the magnitude of pressure signal 456 will cause differential pressure switch 450 to operate valve element 428 to the open position, as indicated by the high volume of arrows 458 passing through fluid control module 410. In the illustrated configuration, tesla valve 460 has little or no effect on fluids flowing in the production direction.

In FIG. 10B, a low viscosity fluid, such as water, is being produced through fluid control module 410 and is represented by hollow arrows 462. As discussed herein, viscosity sensitive channel 438*b* has a small influence on the velocity of a low viscosity fluid flowing therethrough such that the magnitude of pressure signal 456 will cause differential pressure switch 450 to operate valve element 428 to the closed position, as indicated by the low volume of arrows 462 passing through fluid control module 410, which may represent flow passing only through secondary fluid pathway 438. In the illustrated configuration, tesla valve 460 has little or no effect on fluids flowing in the production direction.

In FIG. 10C, a treatment fluid represented by solid arrows 464 is being pumped from the surface through fluid control module 410 for injection into the surrounding formation or wellbore. Tesla valve 460 provides significant resistance to fluid flow in the injection direction creating a significant pressure loss in fluid flowing therethrough such that the magnitude of pressure signal 456 will cause differential pressure switch 450 to operate valve element 428 to the open position, as indicated by the high volume of arrows 464 passing through fluid control module 410.

Figure 11:
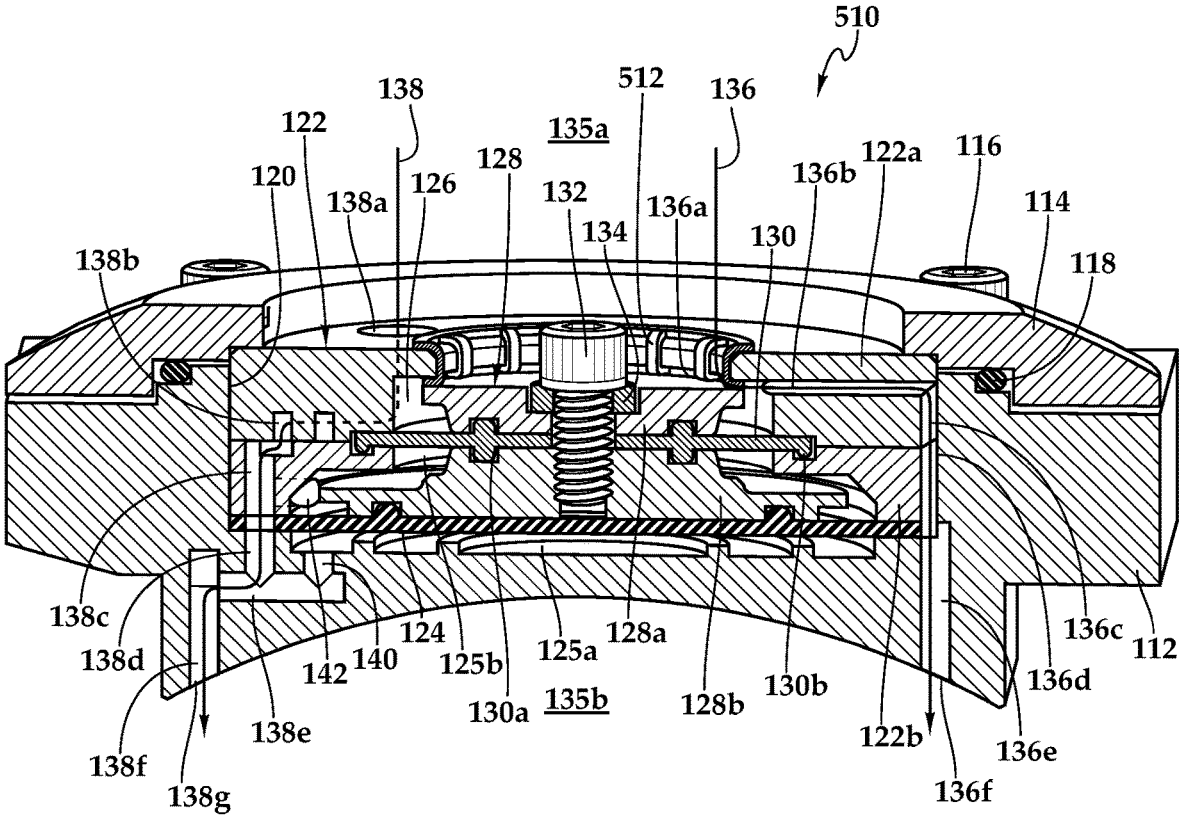
FIG. 11 is a cross sectional view of a downhole fluid flow control system according to embodiments of the present disclosure.

Referring next to FIG. 11, a fluid control module for use in a downhole fluid flow control system of the present disclosure is representatively illustrated and generally designated 510. In the illustrated embodiment, fluid control module 510 is a modified version of fluid control module 110 discussed herein with common numbers referring to common parts. During certain wellbore operations, it may be desirable to have some of the functionality of the fluid control modules in the completion string disabled. For example, having operational fluid control modules in the well during certain operations, such as during the recovery of completion fluids, can be detrimental to the process and/or detrimental to the fluid control modules. Fluid control module 510, overcomes these concerns by including a temporary lockout system that maintains valve element 128 in an open configuration for a predetermined time period.

In the illustrated embodiment, fluid control module 510 includes a dissolvable prop member depicted as dissolvable prop ring 512 that is positioned between valve element 128 and viscosity discriminator disk 122. Dissolvable prop ring 512 is designed to temporary maintain valve element 128 in an open configuration during various well operations prior to bringing the well online for hydrocarbon production. In the illustrated embodiment, dissolvable prop ring 512 includes an upper ring member having a plurality of tines extending therefrom that wrap around an interior surface of viscosity discriminator disk 122 such that the ends of the tines are disposed between valve element 128 and viscosity discriminator disk 122 to prop valve element 128 in an open position. In other embodiments, the dissolvable prop member could be formed from a plurality of separate dissolvable prop elements, each positioned between valve element 128 and viscosity discriminator disk 122. Dissolvable prop ring 512 may be attached to the viscosity discriminator disk 122 by any suitable means. Alternatively or additionally, a dissolvable prop member may be attached to valve element 128 by any suitable means.

Dissolvable prop ring 512 may be formed of any dissolvable material that is suitable for service in a downhole environment and that provides adequate strength to enable proper operation of fluid control module 510 during transient operations. For example, dissolvable prop ring 512 may be formed from a material that is dissolvable in a chemical solution of acidic fluid including fiberglass or certain metals such as aluminum. In another example, dissolvable prop ring 512 may be formed from a material that is dissolvable in a chemical solution of caustic fluid including certain epoxy resins. In a further example, dissolvable prop ring 512 may be formed from a material that is dissolvable in water such as an anhydrous boron compound or hydrolytically degradable monomers, oligomers, polymers and/or mixtures, copolymers and blends thereof including suitable fillers and/or select functional groups along the polymer chains to tailor, for example, the dissolution rate of the material. In yet another example, dissolvable prop ring 512 may be formed from a material that is dissolvable in a hydrocarbon fluid such as an oil or gas soluble resin.

The particular material selected to form dissolvable prop ring 512 may be determined based upon factors including the particular pressure range, temperature range, chemical environment, desired solvent to cause dissolution and/or the dissolution rate as well as other factors that are known to those having ordinary skill in the art. For example, the desired service life for dissolvable prop ring 512 of the present disclosure may be on the order of hours, days, weeks or other timeframe determined by the operator. It is noted that the dissolution solvent may be applied to dissolvable prop ring 512 before or after installation within the well. As one example, the dissolution solvent may be applied before, during or after the completion fluid recovery operations. In another example, when dissolvable prop ring 512 is formed from an oil-soluble or gas-soluble resin, valve element 128 will be maintained in the open configuration until the onset of hydrocarbon production.

Figure 12:
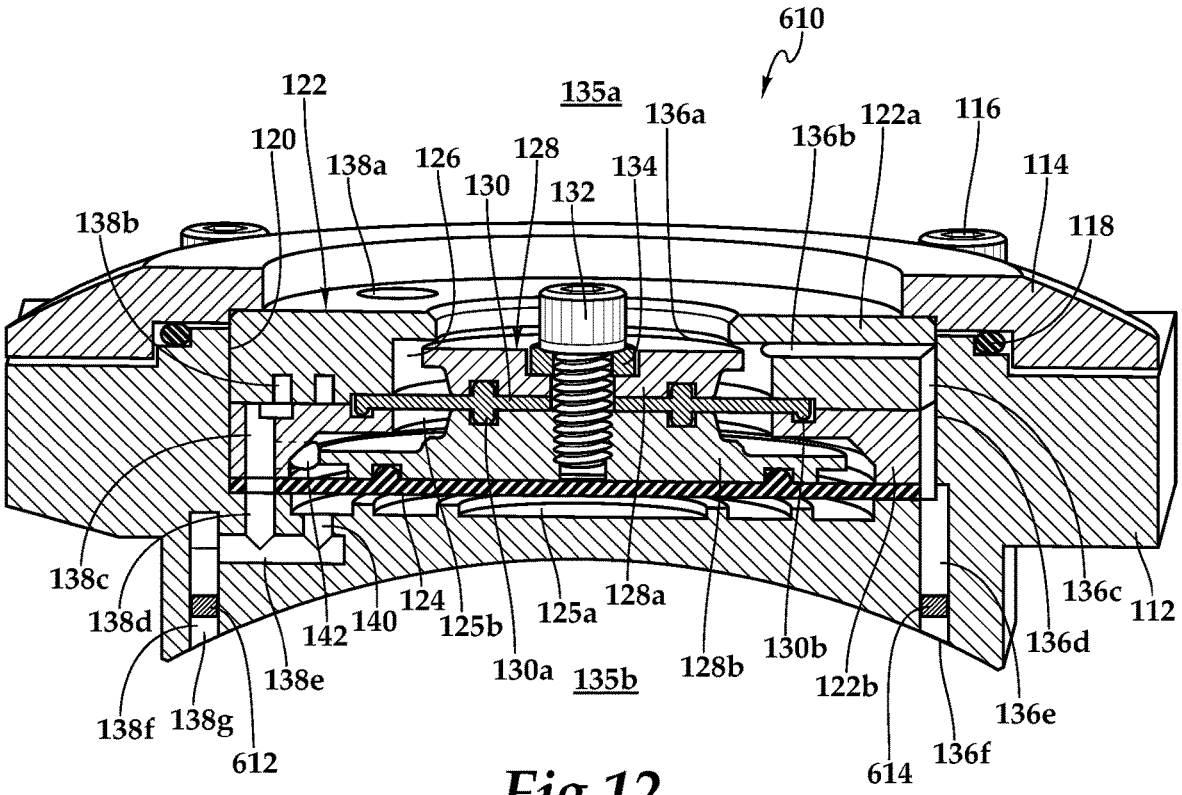
FIG. 12 is a cross sectional view of a downhole fluid flow control system according to embodiments of the present disclosure.

Referring next to FIG. 12, a fluid control module for use in a downhole fluid flow control system of the present disclosure is representatively illustrated and generally designated 610. In the illustrated embodiment, fluid control module 610 is a modified version of fluid control module 110 discussed herein with common numbers referring to common parts. During certain wellbore operations, it may be desirable to have the entire functionality of the fluid control modules in the completion string disabled. For example, having operational fluid control modules in the well during certain operations, such as setting hydraulic packers or operating other pressure actuated devices, can be detrimental to the process and/or detrimental to the fluid control modules. Fluid control module 610, overcomes these concerns by including a temporary blocking system that prevents fluid flow therethrough for a predetermined time period.

In the illustrated embodiment, fluid control module 610 includes a dissolvable plug 612 disposed in secondary fluid pathway 138 near outlet 138*g* and three dissolvable plugs 614, only one being visible in the figure, disposed in main fluid pathway 136 near the three outlets 136*f*. In other embodiments, dissolvable plug 612 could be disposed at other locations within secondary fluid pathway 138. Likewise, one or more dissolvable plugs 614 could be disposed at other locations within main fluid pathway 136. Dissolvable plug 612 is designed to temporary prevent fluid flow through secondary fluid pathway 138 while dissolvable plugs 614 are designed to temporary prevent fluid flow through main fluid pathway 136 prior to bringing the well online for hydrocarbon production.

Dissolvable plugs 612, 614 may be formed of any dissolvable material that is suitable for service in a downhole environment and that provides adequate strength to enable proper operation of fluid control module 610 during transient operations. For example, dissolvable plugs 612, 614 may be formed from any of the materials discussed herein such as materials dissolvable in an acidic fluid, in a caustic fluid, in water and/or in a hydrocarbon fluid such as oil or gas. The particular material selected to form dissolvable plugs 612, 614 may be determined based upon factors including the particular pressure range, temperature range, chemical environment, desired solvent to cause dissolution and/or the dissolution rate as well as other factors that are known to those having ordinary skill in the art. It is noted that the solvent used to dissolve dissolvable plug 612 may be the same as or different from the solvent used to dissolve dissolvable plugs 614.

Figure 13:
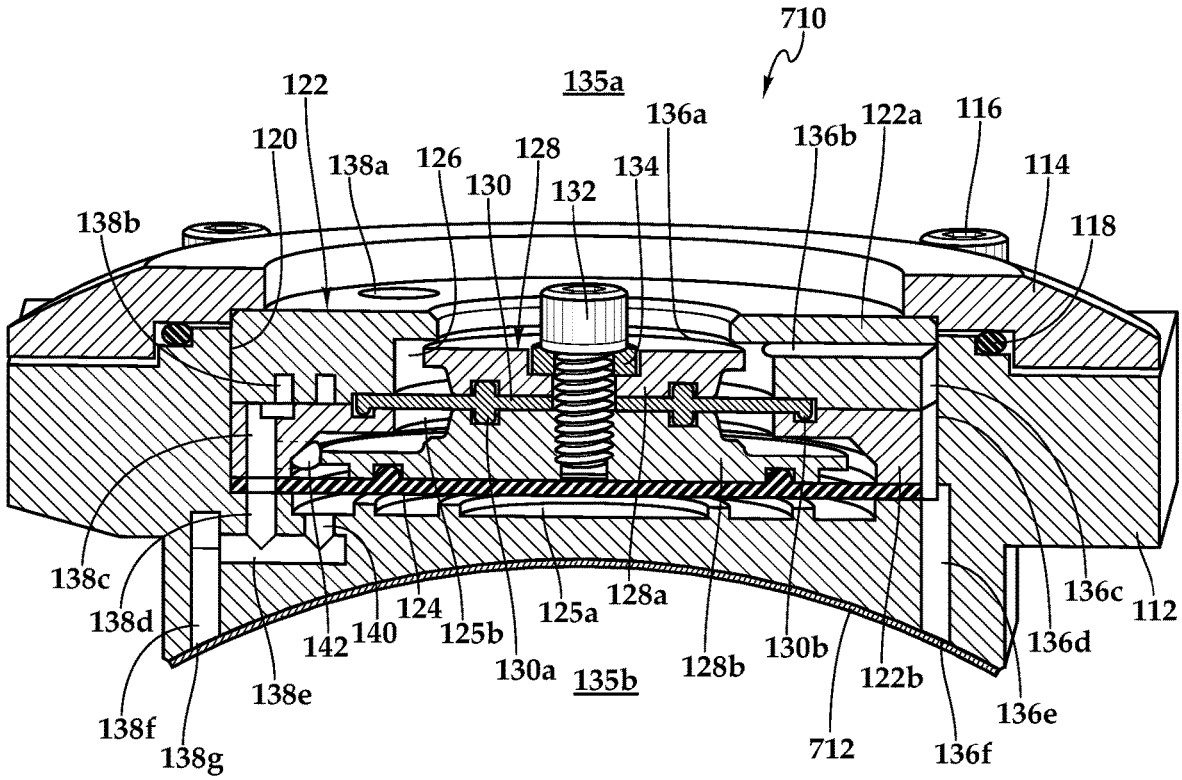
FIG. 13 is a cross sectional view of a downhole fluid flow control system according to embodiments of the present disclosure.

Referring next to FIG. 13, a fluid control module for use in a downhole fluid flow control system of the present disclosure is representatively illustrated and generally designated 710. In the illustrated embodiment, fluid control module 710 is a modified version of fluid control module 110 discussed herein with common numbers referring to common parts. During certain wellbore operations, it may be desirable to have the entire functionality of the fluid control modules in the completion string disabled. For example, having operational fluid control modules in the well during certain operations, such as setting hydraulic packers or operating other pressure actuated devices, can be detrimental to the process and/or detrimental to the fluid control modules. Fluid control module 710, overcomes these concerns by including a temporary blocking system that prevents fluid flow therethrough for a predetermined time period.

In the illustrated embodiment, fluid control module 710 includes a dissolvable layer 712 disposed on the inner surface of housing member 112 that covers outlet 138*g* of secondary fluid pathway 138 and outlets 136*f* of main fluid pathway 136. Dissolvable layer 712 is designed to temporary prevent fluid flow through secondary fluid pathway 138 and main fluid pathway 136 prior to bringing the well online for hydrocarbon production. Dissolvable layer 712 may be formed of any dissolvable material that is suitable for service in a downhole environment and that provides adequate strength to enable proper operation of fluid control module 710 during transient operations. For example, dissolvable layer 712 may be formed from any of the materials discussed herein such as materials dissolvable in an acidic fluid, in a caustic fluid, in water and/or in a hydrocarbon fluid such as oil or gas. The particular material selected to form dissolvable layer 712 may be determined based upon factors including the particular pressure range, temperature range, chemical environment, desired solvent to cause dissolution and/or the dissolution rate as well as other factors that are known to those having ordinary skill in the art.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A downhole fluid flow control system comprising:

a fluid control module having an upstream side and a downstream side, the fluid control module including a main fluid pathway in parallel with a secondary fluid pathway each extending between the upstream and downstream sides;

a valve element disposed within the fluid control module, the valve element operable between an open position wherein fluid flow through the main fluid pathway is allowed and a closed position wherein fluid flow through the main fluid pathway is prevented;

a viscosity discriminator disposed within the fluid control module, the viscosity discriminator having a viscosity sensitive channel that forms at least a portion of the secondary fluid pathway;

a differential pressure switch operable to shift the valve element between the open and closed positions, the differential pressure switch including a first pressure signal from the upstream side, a second pressure signal from the downstream side and a third pressure signal from the secondary fluid pathway, the first and second pressure signals biasing the valve element toward the open position, the third pressure signal biasing the valve element toward the closed position; and a dissolvable prop member configured to maintain the valve element in the open position, the dissolvable prop member operable to be dissolved by a dissolution solvent downhole to allow the valve element to operate between the open and closed positions;

wherein, a magnitude of the third pressure signal is dependent upon the viscosity of a fluid flowing through the secondary fluid pathway; and wherein, the differential pressure switch is operated responsive to changes in the viscosity of the fluid, thereby controlling fluid flow through the main fluid pathway.

2. The flow control system as recited in claim 1 wherein the valve element has first, second and third areas and wherein the first pressure signal acts on the first area, the second pressure signal acts on the second area and the third pressure signal acts on the third area such that the differential pressure switch is operated responsive to a difference between the first pressure signal times the first area plus the second pressure signal times the second area and the third pressure signal times the third area.

3. The flow control system as recited in claim 1 wherein the magnitude of the third pressure signal created by the flow of a desired fluid through the secondary fluid path shifts the valve element to the open position and wherein the magnitude of the third pressure signal created by the flow of a undesired fluid through the secondary fluid path shifts the valve element to the closed position.

4. The flow control system as recited in claim 1 wherein the dissolution solvent further comprises an acidic fluid.

5. The flow control system as recited in claim 1 wherein the dissolution solvent further comprises a caustic fluid.

6. The flow control system as recited in claim 1 wherein the dissolution solvent further comprises water.

7. The flow control system as recited in claim 1 wherein the dissolution solvent further comprises a hydrocarbon fluid.

8. A downhole fluid flow control system comprising:

a fluid control module having an upstream side and a downstream side, the fluid control module including a main fluid pathway in parallel with a secondary fluid pathway each extending between the upstream and downstream sides;

a valve element disposed within the fluid control module, the valve element operable between an open position wherein fluid flow through the main fluid pathway is allowed and a closed position wherein fluid flow through the main fluid pathway is prevented;

a viscosity discriminator disposed within the fluid control module, the viscosity discriminator having a viscosity sensitive channel that forms at least a portion of the secondary fluid pathway;

a differential pressure switch operable to shift the valve element between the open and closed positions, the differential pressure switch including a first pressure signal from the upstream side, a second pressure signal from the downstream side and a third pressure signal from the secondary fluid pathway, the first and second pressure signals biasing the valve element toward the open position, the third pressure signal biasing the valve element toward the closed position; and a plurality of dissolvable plugs configured to block fluid flow through the main and secondary fluid pathways, the dissolvable plugs operable to be dissolved by a dissolution solvent downhole to allow fluid flow through the main and secondary fluid pathways;

wherein, a magnitude of the third pressure signal is dependent upon the viscosity of a fluid flowing through the secondary fluid pathway; and wherein, the differential pressure switch is operated responsive to changes in the viscosity of the fluid, thereby controlling fluid flow through the main fluid pathway.

9. The flow control system as recited in claim 8 wherein the valve element has first, second and third areas and wherein the first pressure signal acts on the first area, the second pressure signal acts on the second area and the third pressure signal acts on the third area such that the differential pressure switch is operated responsive to a difference between the first pressure signal times the first area plus the second pressure signal times the second area and the third pressure signal times the third area.

10. The flow control system as recited in claim 8 wherein the magnitude of the third pressure signal created by the flow of a desired fluid through the secondary fluid path shifts the valve element to the open position and wherein the magnitude of the third pressure signal created by the flow of a undesired fluid through the secondary fluid path shifts the valve element to the closed position.

11. The flow control system as recited in claim 8 wherein the dissolution solvent further comprises an acidic fluid.

12. The flow control system as recited in claim 8 wherein the dissolution solvent further comprises a caustic fluid.

13. The flow control system as recited in claim 8 wherein the dissolution solvent further comprises water.

14. The flow control system as recited in claim 8 wherein the dissolution solvent further comprises a hydrocarbon fluid.

15. A downhole fluid flow control system comprising:

a fluid control module having an upstream side and a downstream side, the fluid control module including a main fluid pathway in parallel with a secondary fluid pathway each extending between the upstream and downstream sides;

a valve element disposed within the fluid control module, the valve element operable between an open position wherein fluid flow through the main fluid pathway is allowed and a closed position wherein fluid flow through the main fluid pathway is prevented;

a viscosity discriminator disposed within the fluid control module, the viscosity discriminator having a viscosity sensitive channel that forms at least a portion of the secondary fluid pathway;

a differential pressure switch operable to shift the valve element between the open and closed positions, the differential pressure switch including a first pressure signal from the upstream side, a second pressure signal from the downstream side and a third pressure signal from the secondary fluid pathway, the first and second pressure signals biasing the valve element toward the open position, the third pressure signal biasing the valve element toward the closed position; and a dissolvable layer disposed on an interior surface of the fluid control module and configured to block fluid flow through the main and secondary fluid pathways, the dissolvable layer operable to be dissolved by a dissolution solvent downhole to allow fluid flow through the main and secondary fluid pathways;

wherein, a magnitude of the third pressure signal is dependent upon the viscosity of a fluid flowing through the secondary fluid pathway; and wherein, the differential pressure switch is operated responsive to changes in the viscosity of the fluid, thereby controlling fluid flow through the main fluid pathway.

16. The flow control system as recited in claim 15 wherein the valve element has first, second and third areas and wherein the first pressure signal acts on the first area, the second pressure signal acts on the second area and the third pressure signal acts on the third area such that the differential pressure switch is operated responsive to a difference between the first pressure signal times the first area plus the second pressure signal times the second area and the third pressure signal times the third area.

17. The flow control system as recited in claim 15 wherein the magnitude of the third pressure signal created by the flow of a desired fluid through the secondary fluid path shifts the valve element to the open position and wherein the magnitude of the third pressure signal created by the flow of a undesired fluid through the secondary fluid path shifts the valve element to the closed position.

18. The flow control system as recited in claim 15 wherein the dissolution solvent further comprises an acidic fluid.

19. The flow control system as recited in claim 15 wherein the dissolution solvent further comprises a caustic fluid.

20. The flow control system as recited in claim 15 wherein the dissolution solvent further comprises water.

21. The flow control system as recited in claim 15 wherein the dissolution solvent further comprises a hydrocarbon fluid.

* * * * *